US011045855B2

(12) United States Patent
Hershberger

(10) Patent No.: US 11,045,855 B2
(45) Date of Patent: Jun. 29, 2021

(54) BENDING MACHINE

(71) Applicant: Nelson Dwayne Hershberger, Mattoon, IL (US)

(72) Inventor: Nelson Dwayne Hershberger, Mattoon, IL (US)

( * ) Notice: Subject to any disclaimer, the term of this patent is extended or adjusted under 35 U.S.C. 154(b) by 233 days.

(21) Appl. No.: 16/078,988

(22) PCT Filed: Nov. 6, 2017

(86) PCT No.: PCT/US2017/060133
§ 371 (c)(1),
(2) Date: Aug. 22, 2018

(87) PCT Pub. No.: WO2019/089054
PCT Pub. Date: May 9, 2019

(65) Prior Publication Data

US 2020/0122211 A1 Apr. 23, 2020

(51) Int. Cl.
*B21D 5/04* (2006.01)
*B21D 5/16* (2006.01)

(52) U.S. Cl.
CPC ..... *B21D 5/042* (2013.01); *B21D 5/16* (2013.01)

(58) Field of Classification Search
CPC ..... B21D 5/02; B21D 5/0281; B21D 5/04; B21D 5/042; B21D 5/047; B21D 37/02; B21D 37/04; B21D 5/045; B21D 5/16; B21D 19/08; B21D 39/02; B21D 39/021
See application file for complete search history.

(56) References Cited

U.S. PATENT DOCUMENTS 343,700 A * 6/1886 Cortright ..... B21D 5/04 72/323
3,913,370 A 10/1975 Break
4,137,748 A * 2/1979 Grombka ..... B30B 15/0047 72/448
4,282,735 A * 8/1981 Break ..... B21D 5/042 72/319
4,321,817 A * 3/1982 Barnack ..... B29C 53/04 267/265
4,449,389 A * 5/1984 Cros ..... B21D 5/0272 72/389.5

(Continued)

FOREIGN PATENT DOCUMENTS

WO 2007102176 A1 9/2007

*Primary Examiner* — Edward T Tolan
(74) *Attorney, Agent, or Firm* — Nath, Goldberg & Meyer; Richard C. Litman

(57) ABSTRACT

The bending machine (100) has an upper beam (211) and a lower beam (212), each of the beams (211, 212) having a clamping element extending therefrom adapted for clamping an elongated flat sheet metal workpiece (218) with a portion extending from the machine in cantilever fashion. Bending tool carriers (221, 222) having a bending tool (223, 224) extending therefrom are movable relative to the beams so that the bending tool (223, 224) can extend and pivot to form an elongated bend in the workpiece (218). A plurality of wedges (251, 252) are selectively extendable between the beams (211, 212) and the carriers (221, 222) to provide uniform depth of the bend in the workpiece (218) along the length of the bend, the depth of extension being adjustable with ball screws (261, 262) attached to synchro or servo-motors (265, 266).

9 Claims, 6 Drawing Sheets

(56) References Cited

U.S. PATENT DOCUMENTS

| | | | | | |
|---|---|---|---|---|---|
| 5,474,437 | A * | 12/1995 | Kuroyone | B21D 5/01 | 425/150 |
| 5,802,906 | A * | 9/1998 | Lillbacka | B21D 5/045 | 72/294 |
| 5,878,618 | A * | 3/1999 | Stalzer | B21D 5/02 | 100/271 |
| 5,927,135 | A | 7/1999 | Kutschker | | |
| 6,324,882 | B1 | 12/2001 | Kutschker et al. | | |
| 6,427,511 | B1 | 8/2002 | Kutschker et al. | | |
| 6,470,727 | B1 * | 10/2002 | Kunze | B21D 5/045 | 72/323 |
| 6,516,648 | B1 | 2/2003 | Kutschker et al. | | |
| 6,860,133 | B2 * | 3/2005 | Kobayashi | B21D 11/00 | 72/313 |
| 7,901,341 | B2 * | 3/2011 | Shimizu | B21D 5/02 | 483/29 |
| 2005/0160781 | A1 | 7/2005 | Kutschker | | |
| 2009/0255315 | A1 | 10/2009 | Break | | |
| 2010/0147046 | A1 | 6/2010 | Allen et al. | | |
| 2011/0265546 | A1 | 11/2011 | Wilson | | |
| 2016/0107847 | A1 | 4/2016 | Grunewald et al. | | |

* cited by examiner

BENDING MACHINE

TECHNICAL FIELD

This disclosure relates to machine shop apparatus for shaping and forming sheet metal, and particularly to a bending machine having wedges extendable between the bending beams and the bending tool carriers to ensure a uniform bend along the entire length of a flat workpiece.

BACKGROUND ART

A bending brake, sometimes called "sheet metal brake", "bending machine" or "sheet metal folder", and "brake" or "folder", are machines capable of creating a bend or fold in sheet metal. In its simplest form, the brake creates a linear bend in the sheet metal; however, more complex bends and shapes are possible.

One particular type of brake, often specifically referred to as a "folder," is described in U.S. Pat. No. 6,324,882, issued to Kutschker, et al. on Dec. 4, 2001, which is hereby incorporated by reference in its entirety. The bending machine described in the '882 patent is configured so that upper and lower beams terminate in clamping tools to support the work. At least one tool carrier terminates in a bending tool having a curved pressure surface to press against the work to bend the work against the clamping tools. A lower beam arranged on the machine's frame and an upper beam arranged on the machine's frame are configured so that the work can be fixed in position. A bending tool moving device allows a bending tool to be moved in such a manner that the movements of the bending tool can be effected.

The bending tool has a bending nose with a curved pressure surface for acting upon one side of the flat material. The bending tool is movable by the bending tool moving device between a starting bending position and an end bending position on a path about the respective bending edge, which is predetermined, in a defined manner such that the curved pressure surface and the side of the flat material acted upon move relative to one another in the form of an essentially slide-free rolling on one another.

In this type of brake, each tool carrier is mounted at multiple stations across the width of the machine. The tool carrier terminates in a bending tool. The tool carrier is attached to its respective beam by double-hinged arrangements at each station and is attached to the machine's frame by actuators, also at each station. In operation, at each station, the double-hinged arrangements cause a point on the tool carrier (defined by the hinge) to maintain a fixed distance from a corresponding point on the beam. When the actuators extend, the bending tool engages the work and bends the work.

An inherent problem with this type of bending machine is over-bending at the ends of the material being bent. The result is that taken across the width of a bend, the ends of the work tend to retain a greater bend angle than the center, resulting in a cupped bend. In part, this is due to the effects of elastic deformation and plastic deformation across the width of the work, which results in the ends of the metal having less spring back than the center station. The cupping can also be the result of the work being narrower at its bend width than the row of stations. In some work products, the cupping is of little consequence, in that the distortion can be manually corrected or corrected by additional hardware, such as formers and end caps. However, there are some products for which distortion or cupping is difficult to correct. Nevertheless, it is typically desired that the bend have a constant bend angle across the width of the work. It is also an issue that it is difficult to achieve precise movement with the actuators, so that the angle of the bend becomes difficult to maintain during operation.

The problem of over-bending at the ends becomes exaggerated when multi-bend radii are formed, in which case the effect of over-bending at the ends is cumulative across the multiple bends, forming a radius.

Another problem is that in some operations, the work tends to slide across the clamping tools. This particularly becomes an issue when the clamping tools themselves are used to directly perform bending or folding, rather than gripping the work when the tool carrier is engaging the work to create the bend. One example of this type of operation is in closing hems. When using a folder to close hems, a bend is first introduced, forming an acute fold angle. The folder is then used to clamp the work at the bend, essentially creating a 180° bend. Ideally, the work should be held securely so that the work does not "walk" within the folder. Another desired feature would be to retain the crease of the fold at all times outside of direct engagement with the folder when the hem is closed. By retaining the crease of the fold outside of the radius, this would preserve the radius of the bend rather than crushing or flattening the work at the crease.

Thus, a bending machine solving the aforementioned problems is desired.

DISCLOSURE OF INVENTION

The bending machine has an upper beam and a lower beam, one or both of the beams having a clamping element extending therefrom adapted for clamping an elongated flat sheet metal workpiece with a portion extending from the machine in cantilever fashion. Bending tool carriers having a bending tool extending therefrom are movable relative to the beams so that the bending tool can extend and pivot to form an elongated bend in the workpiece. A plurality of wedges are selectively extendable between the beams and the carriers to provide uniform depth of the bend in the workpiece along the length of the bend, the depth of extension being adjustable with linear adjustment devices. The linear adjustment devices can be any convenient adjustment mechanism that causes linear movement of the wedges, including, e.g., ball screws, gear arrangements, threaded positioners, and similar devices. Additionally, rotary positioners can be used, so long as they are connected to linearly move the wedges. The adjustment mechanism may be attached to synchros or servomotors, which facilitates electronic control. It is also possible to use solenoids or other electrical devices that respond proportionally to electric power. It is further possible to provide hydraulic actuation for the adjustment mechanisms.

These and other features of the present disclosure will become readily apparent upon further review of the following specification and drawings.

BRIEF DESCRIPTION OF DRAWINGS

Similar reference characters denote corresponding features consistently throughout the attached drawings.

BEST MODE(S) FOR CARRYING OUT THE INVENTION

Figure 1:
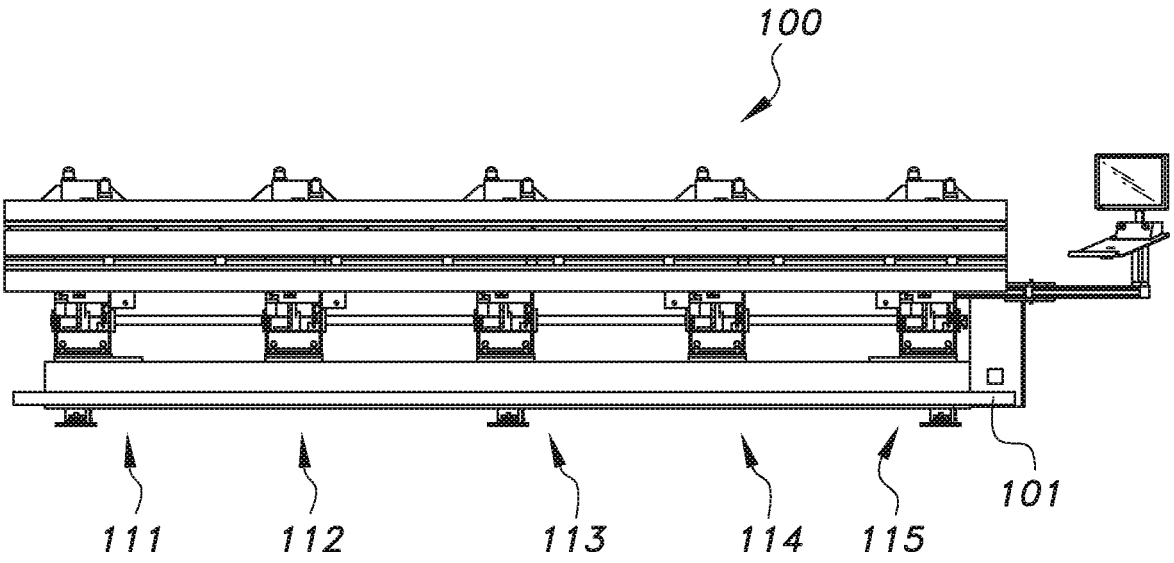
FIG. 1 is a schematic diagram showing a multi-station bending machine.

The bending machine has an upper beam and a lower beam, one or both of the beams having a clamping element extending therefrom adapted for clamping an elongated flat sheet metal workpiece with a portion extending from the machine in cantilever fashion. Bending tool carriers having a bending tool extending therefrom are movable relative to the beams so that the bending tool can extend and pivot to form an elongated bend in the workpiece. A plurality of wedges are selectively extendable between the beams and the carriers to provide uniform depth of the bend in the workpiece along the length of the bend, the depth of extension being adjustable with adjustment mechanisms, which may be controlled by synchros or servomotors.

The sheet metal bending brake or bending machine for sheet metal uses a wedge arrangement between at least one beam and an associated tool carrier. By adjusting the wedges, the bending near the center of the brake can be increased with respect to the bending near the edges of the brake. This adjustment can be used to render a more even or uniform bend across the length of the bend. The terminology "length of the bend", it is intended to mean the dimension along the crease or bend or parallel to the bend or crease.

In one configuration, the wedges are arranged with a first set of wedges between an upper beam and a corresponding upper bending tool carrier, and a second set of wedges between a lower beam and a lower bending tool carrier. The wedges establish a contour of the bend angles along the length of the bend intended to compensate for differences in resiliency of the work at the edges of the work at the bend as opposed to the center of the work at the bend, and therefore render a desired contour of the bend. As a result of the insertion of the wedges, the tool carrier and, to a lesser extent, the beams are able to warp sufficiently to effect a non-straight profile of the bending movement applied to the work. The bending movement includes compensation for differences in the final bend of the work effected by the brake after the work is released from the brake. In the usual case, the desired contour of the bend would be a continuous angle across the length of the workpiece, so that the compensation would be sufficient to create an even bend in the work. By adjusting the central wedges to increase the bending near the center of the brake, and adjusting the outer wedges to decrease bending near the ends of the brake, this problem can be eliminated.

The wedges also prevent the bending tool carriers from distorting when the work is narrower than the width of the bending tool carriers. Thus, the movement of a bending tool carrier at stations along the width of the tool carrier can be maintained, regardless of whether the width of the work is such that the work extends across each station.

In a particular configuration, the wedges are adjustably moved toward or away from the location of the bend by adjustment mechanisms. The adjustment mechanisms are mounted to the frame of the machine to adjustably connect the wedges to the frame and effect adjustment of the wedges by adjusting a distance between the mounting points of the adjustment mechanisms to the frame and the wedges. The adjustment mechanisms can be controlled by electrical synchros or servomotors to allow automated adjustment of the wedges, for example, for different lengths of the bend and for different thicknesses of the work.

A particular configuration comprises a first row of wedges between an upper beam and the upper bending tool carrier, and a second row of wedges between a lower beam and a lower bending tool carrier. The wedges are separated from each other along the width of the bend according to the particular configuration of the brake.

The disclosed bending brake has at least one beam supporting a workpiece, typically in a clamping arrangement, and at least one bending tool carrier terminating in a bending tool. The bending tool bends the workpiece against the beam to establish a bend or fold along the length of the workpiece. A series of wedges are fitted between the beam and the bending tool carrier. Adjustment mechanisms control the distance of the wedges from the bending tool, so that the adjustment causes a differential in the bending of the workpiece across the length of the workpiece. The differential may be achieved by the wedges causing the bending tool carrier to warp sufficiently to effect the differential in the bending of the workpiece across the length of the workpiece.

The configuration allows the tool carriers to be used to directly press the work, while the beam or beams are maintained in a gripping mode. This allows the clamping beams to remain clamped, and the final folding operation is performed by the tool carriers. Since the clamping beams remain clamped, the work is less likely to "walk" or slide across its desired position during the final folding operation. In another configuration, the bend is not performed by bending the workpiece against the clamping beam, but by supporting the workpiece on one bending tool, used similar to an anvil, while the other bending tool is used to form the bend. One example of this type of operation is in closing hems. When using a folder machine to close hems, a first bend is first introduced in the normal fashion, forming an acute fold angle. The folder is then used to clamp the work with the bend extended away from the clamping beams and supported atop one bending tool while the other tool completes the bend, essentially creating a 180° bend. By retaining the crease of the fold outside of the radius of the bending tool, rather than crushing or flattening the work at the crease, the radius of the bend is preserved.

The adjustment mechanisms may include any mechanical linear actuator that translates rotational motion to linear motion, e.g., ball screws, gear arrangements, threaded positioners, and similar devices. Additionally, rotary positioners can be used, so long as they are connected to linearly move the wedges. The adjustment mechanism may be attached to synchros or servomotors, which facilitates electronic control. It is also possible to use solenoids or other electrical devices that respond proportionally to electric power (typically voltage). The adjustment mechanisms may also be hydraulic actuators, which are controlled either by volume (fluid flow) or by control of hydraulic pressure. The fluid flow or hydraulic pressure to the actuators can be electronically controlled by a machine controller by the use of appropriate control valves as is understood by those skilled in the art.

The adjustment mechanisms effect movement of the wedges in a direction toward or away from the bending head. The wedges are selectively extendable between the beams and the carriers by adjustment with linear adjustment devices. At least a subset of the adjustment mechanisms has a synchro or servomotor drives, which controls the position of the respective wedge with respect to the bending tool.

Figure 2:
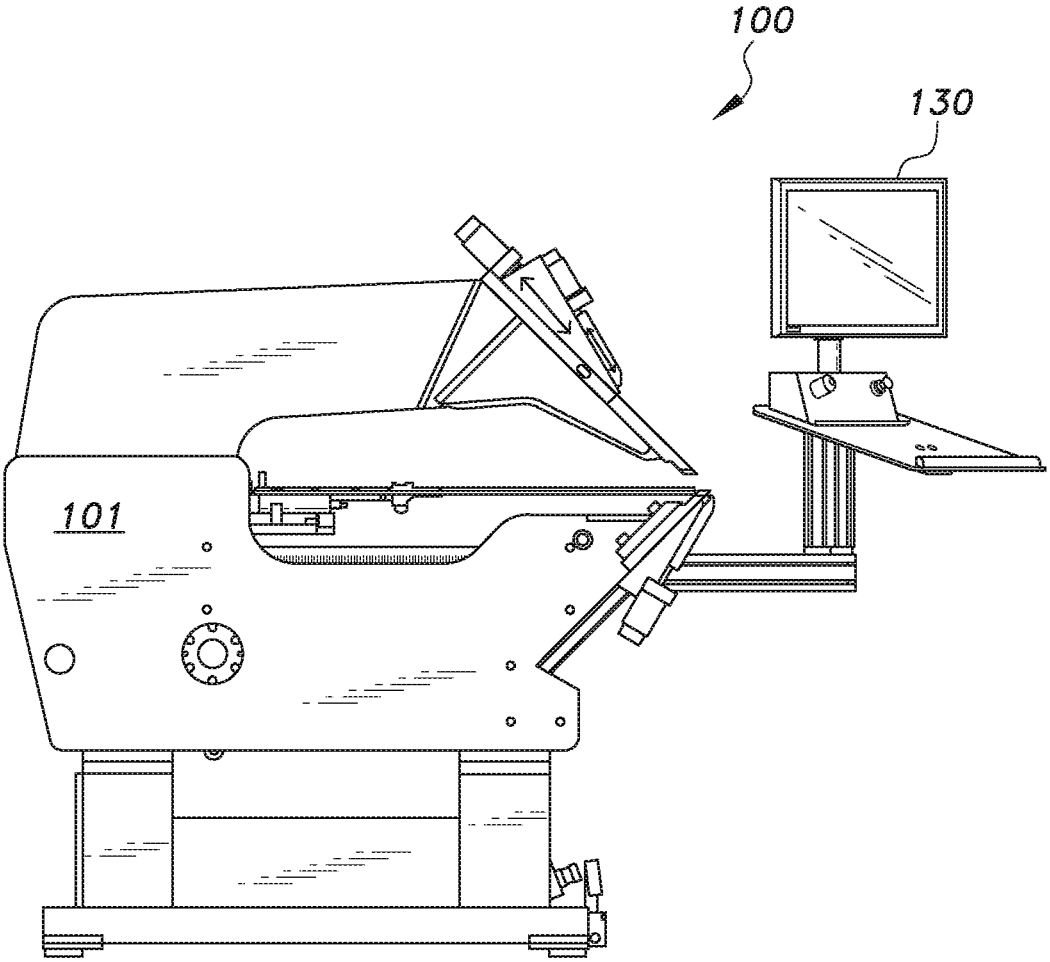
FIG. 2 is a schematic diagram showing one end of the bending machine of FIG. 1.
Figure 3:
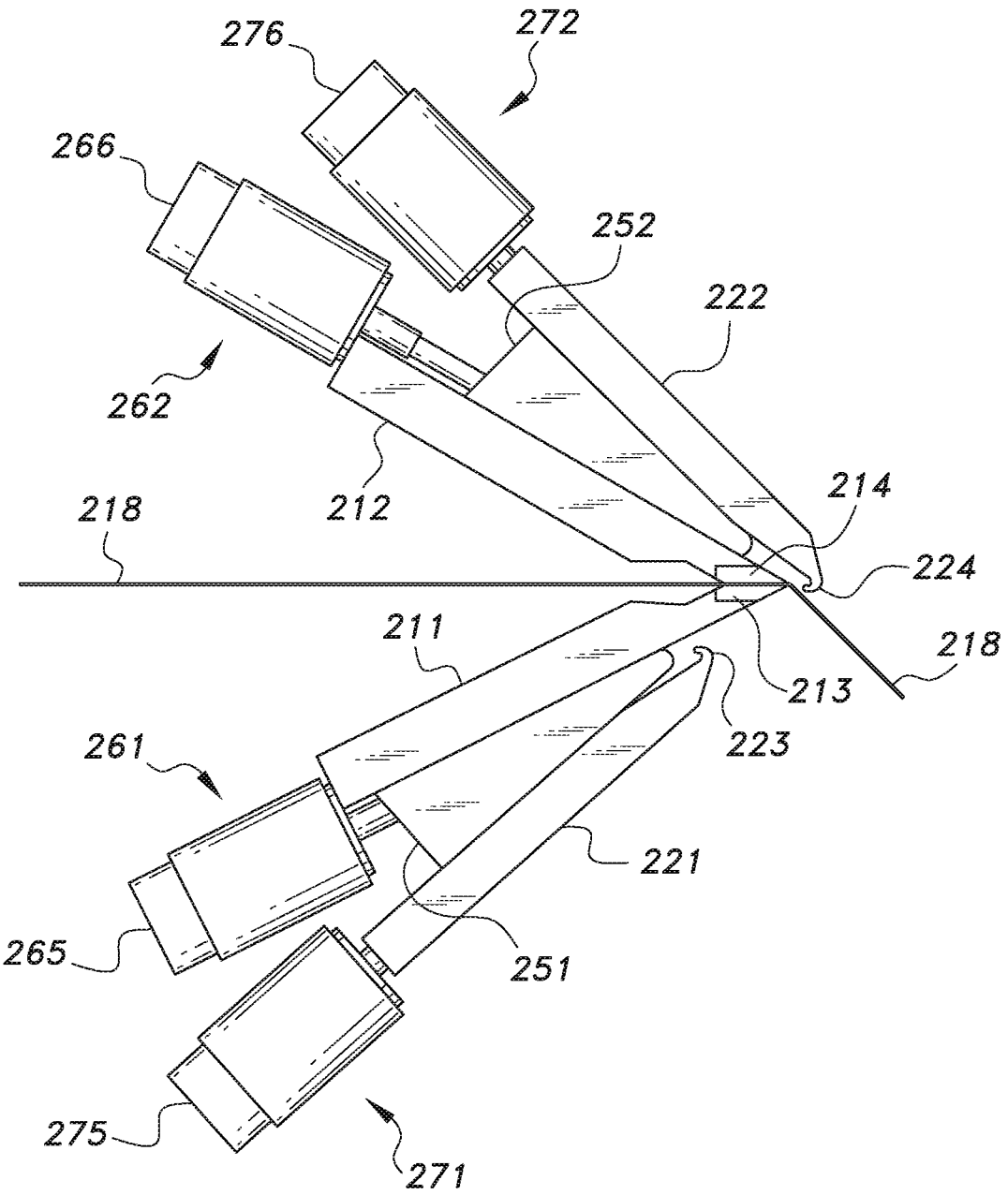
FIG. 3 is a schematic diagram showing the arrangement of the clamping and bending station of the bending machine of FIG. 1, using wedges.
Figure 4:
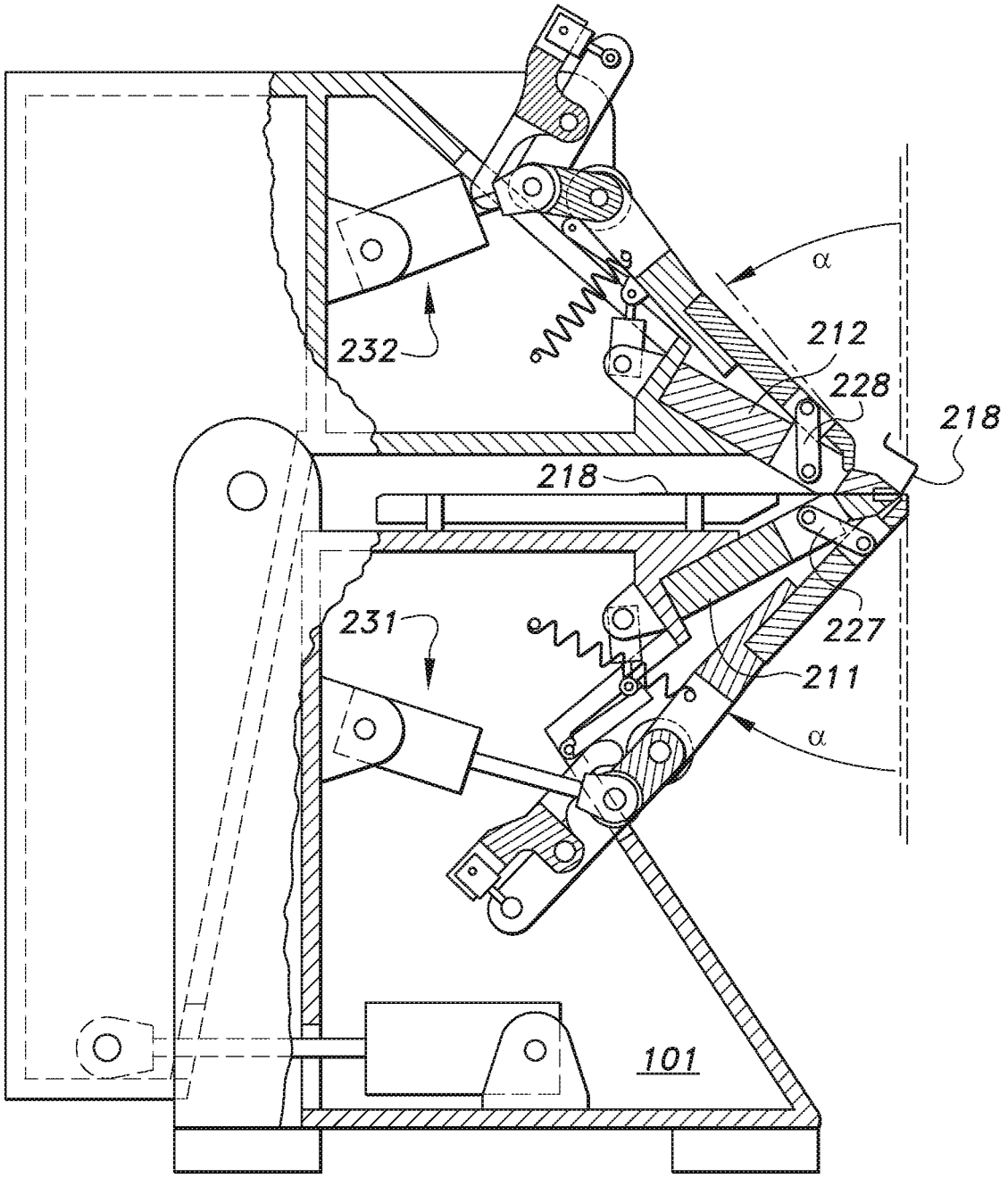
PRIOR ART FIG. 4
FIG. 4 is a schematic diagram showing details of the clamping and bending station of a bending machine of the prior art.

FIGS. 1-3 are schematic diagrams of an exemplary bending machine 100 according to the present disclosure. FIG. 1 is a schematic diagram showing the machine 100. FIG. 2 is a schematic diagram showing one end of a station of the machine 100. FIG. 3 is a schematic diagram showing details of the clamping and bending apparatus of the station of FIG. 2. FIG. 4 is a schematic diagram showing details of the clamping and bending station of a bending machine of the prior art.

Referring to FIGS. 1-3, depicted is a chassis 101, which functions as a frame of the machine 100 and has fixed thereto a plurality of stations 111, 112, 113, 114, and 115. Since stations 111-115 are fixed to the chassis 101, the stations 111-115 are mechanically and functionally part of the chassis 101. Also mounted to the chassis 101 is a machine controller 130.

Chassis 101, in its function as a frame, supports lower and upper clamp beams 211, 212 at stations 111-115. Lower and upper clamp beams 211, 212 terminate in lower and upper clamping elements 213, 214, which are used to clamp the workpiece 218. Lower and upper bending tool carriers 221, 222 with bending tools 223, 224 or bending noses extending therefrom are supported by lower and upper hinge assemblies 227, 228 (shown in FIG. 4) on lower and upper clamp beams 211, 212.

Bending actuator mechanisms 231, 232 (shown in FIG. 4) are connected to the lower and upper bending tool carriers 221, 222, and act against the hinge assembly 227 or 228 to draw its respective bending tool 223 or 224 against the workpiece 218 at clamping elements 213, 214. The movement of bending tool 223 or 224 against the workpiece 218 at clamping elements 213, 214 causes the workpiece 218 to bend, as is common in sheet metal bending machines, in the manner described in U.S. Pat. No. 6,324,882.

The plurality of stations 111-115 function as holding units, each of which has a separate set of bending actuator mechanisms 231, 232 and hinge assemblies 227, 228. The bending actuator mechanisms 231, 232 may have a common drive, or may use separate actuator mechanisms per station. In this way, a bending actuator mechanism 231, 232 at each station 111-115 acts against the hinge assembly 227 or 228 at its respective station. Clamp beams 211, 212 and bending tool carriers 221, 222 extend across the length of the chassis 101. Therefore, differential movement of bending actuator mechanisms 231, 232 at the different stations 111-115 allows bending actuator mechanisms 231, 232 to warp across the length of the chassis 101. In normal operation the warpage is well within the elastic deformation range of the component parts of bending brake 100. However, the warpage results in a differential bending movement to the workpiece 218.

Wedges 251 are positioned between lower clamp beam 211 and lower bending tool carriers 221 at each station. Likewise wedges 252 are positioned between upper clamp beam 212 and upper bending tool carriers 222. Wedges 251, 252 are adjusted by means of adjustment mechanisms, shown in FIG. 3 as ball screw adjustment assemblies 261, 262. Adjustment assemblies 261, 262 cause the wedges 251, 252 to be moved closer to or further from the bend in the workpiece 218. Adjustment mechanisms 261, 262 are controlled by synchros or servomotors 265, 266, so that adjustment can be effected by the controller 130. In this manner, the bending machine 100 can be used for making sequential bends with different adjustments of adjustment assemblies 261, 262.

Bending tools 223, 224 can also press together in front of the clamp beams 211, 212 to close hems by walking the edge around. This provides an alternative to using the clamp beams 211, 212 to crush the hem. Since clamp beams 211, 212 are not performing the closing operation, there is less tension at the hem, which could cause the open hem edge to slip while being pressed into a flat hem. Since the positions of the bending tools 223, 224 with respect to the work are more precisely controlled, it is possible to maintain a radius profile of the fold. Since it is possible to maintain a radius profile of the fold, it is possible to form a hem with a raised fold.

Lower and upper bending tool carriers 221, 222 are also adjusted in a direction toward or away from the bend of the workpiece 218, generally in the same direction as the adjustment of the wedges, skewed by an angle that the wedges are moved. Adjustment mechanisms 271, 272 are used to perform this adjustment, and synchros or servomotors 275, 276 are used to control the adjustment mechanisms 271, 272. The adjustment mechanisms 271, 272 allow the positions of the bending tools 223, 224 to be adjusted to compensate for the movement of the wedges 251, 252. Since the positions of bending tools 223, 224 are adjusted to compensate for the movement of wedges 251, 252, adjustments of wedges 251, 252 are less likely to move bending tools 223, 224 out of an optimum alignment with the workpiece 218.

While lower and upper bending tool carriers 221, 222 and associated components are described, it is expected that some configurations will use only lower bending tool carriers 221 and associated components, or will use only upper bending tool carriers 222 and associated components. It is also possible to provide the wedges 251 or 252 and associated adjustment components for only the lower or upper tool carriers 221 or 222, according to design choice.

The wedges 251, 252 and bending tool carriers 221, 222 are adjusted to provide a differential in the adjustment across the length of clamp beams 211, 212 and bending tool carriers 221, 222. This results in a warpage across the length of bending tool carriers 221, 222 (unless the adjustment is even for all stations 111-115). In setting up the bending machine 100, a determination of a bending adjustment across the length of the work is made, either by calculation or by estimate and trial and error adjustment. In a typical case, the adjustment is made to reduce the bending angle $\alpha$ at the widthwise ends of the work with respect to the center of the work in order to achieve an even or uniform bend angle in the workpiece 218 resulting from the bending operation. The adjustment is limited to a degree that avoids plastic distortion of the component parts of the bending brake 100.

Figure 5:
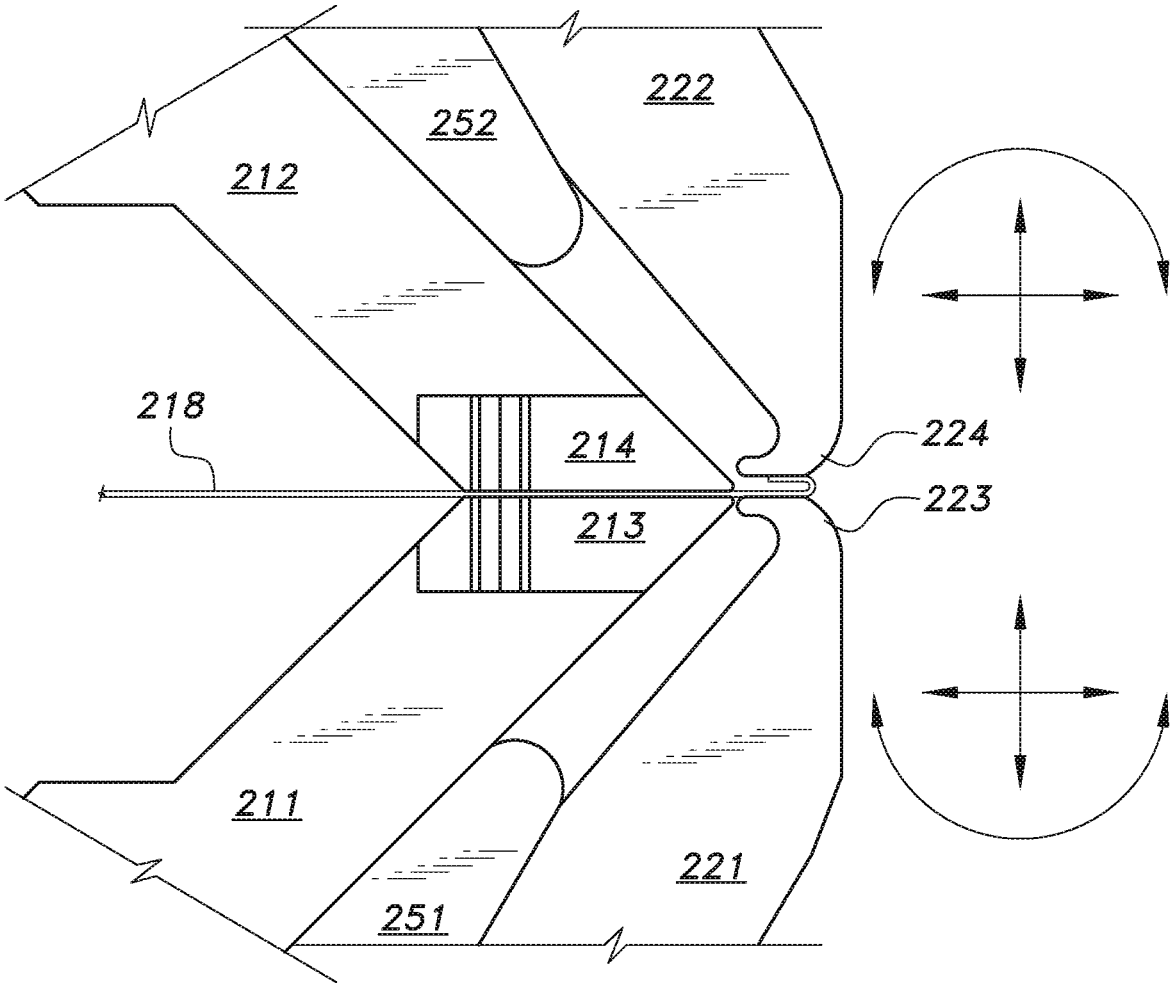
FIG. 5 is a schematic diagram showing the bending machine forming a hem in a sheet metal workpiece.

The configuration allows the tool carriers to be used to directly press the work, while the beam or beams are maintained in a gripping mode, as shown in FIGS. 5 and 6A-6E. FIG. 5 is a schematic diagram of the gripping mechanism of brake 100, with lower and upper clamp beams 211, 212 and lower and upper bending tool carriers 221, 222.

Lower and upper bending tool carriers 221, 222 can be used to effect a hemming or folding operation by using bending tools 223, 224 to press a fold in the work together using the back side of bending tools 223, 224. This allows the clamp beams 211, 212 to remain clamped, with the final folding operation performed by the tool carriers 221, 221. Since clamp beams 211, 212 remain clamped, the work is less likely to "walk" or slide across its desired position within the clamping tools position during the final folding operation. Referring to FIG. 5, bending tool carriers 221, 222 can be positioned with the help of wedges 251, 252, so that the back sides of bending tools 223, 224 have a desired alignment with respect to the work 218. Adjustment mechanisms 275, 276 can be used to adjust the positions of bending tool carriers 221, 222, and by adjusting the positions of bending tool carriers 221, 222, a desired positioning of bending tool carriers 221, 222 is used to position bending tools 223, 224.

Figure 6A:
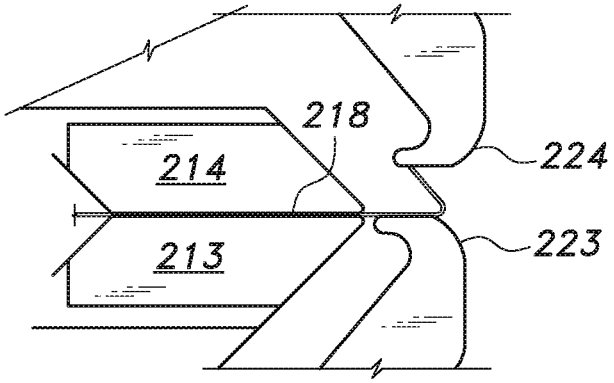
FIGS. 6A, 6B, 6C, 6D, and 6E are schematic diagrams showing the sequence of bends made by the bending machine to form a hem.
Figure 6B:
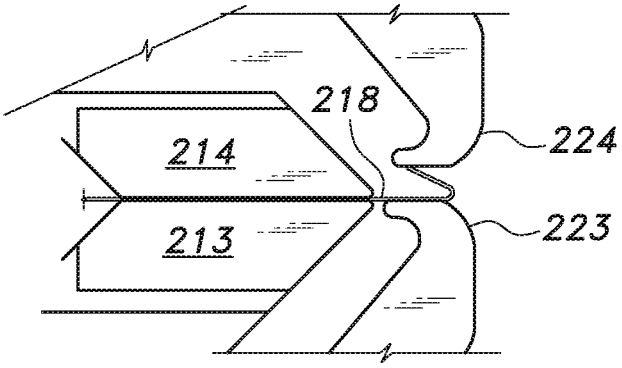
Figure 6C:
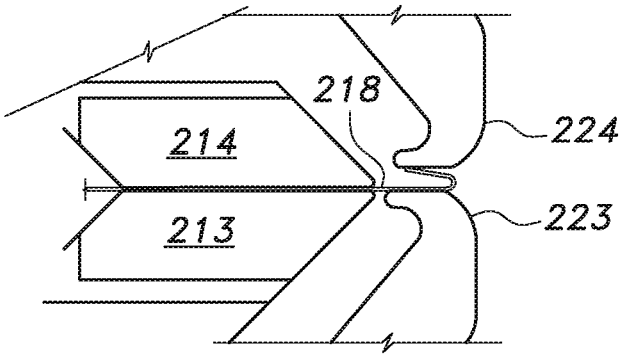

One example of this type of operation is in closing hems, depicted schematically in FIGS. 6A-6E. When using a folder to close hems, a bend is first introduced, forming an acute fold angle. The folder is then used to clamp the work near the bend, and bending tool carriers bring bending tools 223, 224 into alignment with the work 218 at the fold, as shown in FIG. 6A. As noted, the upper bending tool 224 is skewed outward with respect to the lower bending tool 223, which aligns the bending tools 223, 224 with the halves of the fold at this stage of operation. As can be seen in FIGS. 6B and 6C, the upper bending tool 224 is brought down and rearward so that a contact location of upper bending tool 224 with the edge of the work 218 is maintained substantially constant. During this time, the lower and upper clamp beams 211, 212 and the lower and upper clamping elements 213, 214 secure the work 218 in position. Since this is a flat fold, the lower bending tool 223 is substantially in-line with the clamping elements 213, 214. However, it is also possible to position the bending tools 223, 224 to form an angled hem.

Figure 6D:
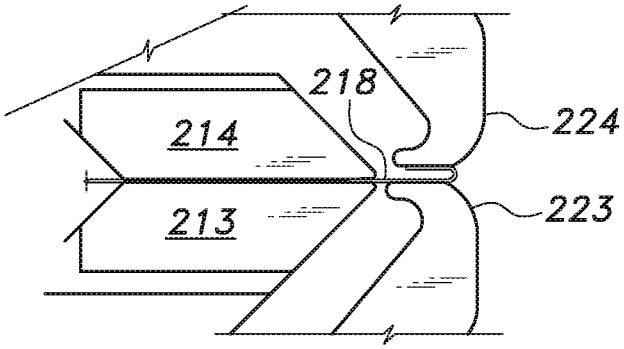
Figure 6E:
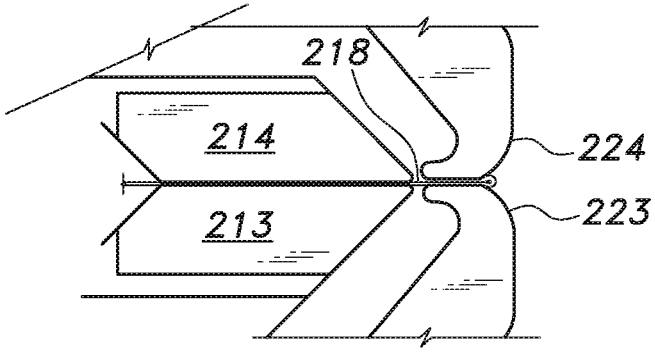

In FIG. 6D, the bending tools 223, 224 are closed, thus closing the hem, essentially creating a 180° bend. Since the positions of the bending tools 223, 224 with respect to the work 218 are controlled by both controlling bending tool carriers 221, 222 and by securing the work 218 with clamping elements 213, 214, the work is held securely so that the hem does not "walk" within the folder. It is also possible to effect the closing of the hem in a manner that leaves a radius of the fold intact, so that the radius is not crushed. By retaining the crease of the fold outside of the radius, this would preserve the radius of the bend rather than crushing or flattening the work at the crease.

The adjustments of wedges 251, 252 and bending tools 223, 224 allows the folding of the hem to take place with a minimum of displacement or "walking" of bending tools 223, 224 against the work 218. By using the adjustments of synchros 265, 266, 275, 276, the contact points of bending tools 223, 224 against the work 218 can be held constant, although this may be somewhat achievable by selection of an initial adjustment of adjustment mechanisms 265, 266, 271, 272.

The folding operation can also be performed with a single bending tool, such as upper bending tool 224. This can be accomplished by extending one of the clamping elements, in this example, lower clamping element 213 outward from the clamp position, while still allowing upper clamping element 214 to engage the work 218 against the remaining portion of lower clamping element 213. Alternatively, the work can be folded without the use of clamping elements 213, 214, either with an auxiliary clamp (not shown) or by allowing free movement of the work 218.

It is to be understood that the bending machine is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A bending machine, comprising:

an upper beam and a lower beam, each of the beams having a workpiece clamping element extending therefrom adapted for clamping a flat elongated sheet metal workpiece therebetween with at least an edge of the workpiece extending beyond the clamping elements in cantilever fashion;

at least one bending tool carrier having a bending tool extending therefrom, the tool carrier being movable relative to a corresponding one of the beams and the bending tool being pivotal to exert pressure for folding the workpiece against the clamping elements to form an elongated fold in the workpiece;

a wedge extendable between the corresponding one of the beams and the at least one bending tool carrier; and an adjustment screw attached to the wedge for adjusting extension of the wedge between the corresponding one of the beams and the at least one bending tool carrier to provide uniform depth of the bend in the workpiece along the entire length of the fold.

2. The bending machine of claim 1, wherein the adjustment screw comprises a ball screw.

3. The bending machine of claim 2, further comprising a servomotor connected to the ball screw for adjusting extension of the wedge.

4. The bending machine of claim 1, further comprising:

a controller; and a bending tool actuator connected to the controller and to the at least one bending tool carrier to effect movement of the at least one bending tool carrier to bring the bending tool into contact with the workpiece for bending the workpiece.

5. The bending machine of claim 1, wherein said at least one bending tool carrier comprises an upper bending tool carrier having an upper bending tool extending therefrom and a lower bending tool carrier having a lower bending tool extending therefrom.

6. The bending machine of claim 1, further comprising a hinge assembly connected between said at least one bending tool carrier and said corresponding one of the beams.

7. A method of operating a bending machine to fold an elongated flat sheet of sheet metal, comprising the steps of:

providing at least one bending machine, the at least one bending machine comprises:

an upper beam and a lower beam, each of the beams having a workpiece clamping element extending therefrom adapted for clamping a flat elongated sheet metal workpiece therebetween with at least an edge of the workpiece extending beyond the clamping elements in cantilever fashion;

at least one bending tool carrier having a bending tool extending therefrom, the tool carrier being movable relative to a corresponding one of the beams and the bending tool being pivotal to exert pressure for bending the workpiece against the clamping elements to form an elongated fold in the workpiece;

a wedge extendable between the corresponding one of the beams and the at least one bending tool carrier;

an adjustment screw attached to the wedge for adjusting extension of the wedge between the corresponding one of the beams and the at least one bending tool carrier to provide uniform depth of the fold in the workpiece along the entire length of the fold;

a controller; and a bending tool actuator connected to the controller and to the at least one bending tool carrier to effect movement of the at least one bending tool carrier to bring the bending tool into contact with the workpiece for folding the workpiece;

selectively adjusting extension and retraction of a plurality of wedges extending between clamping beams and bending tool carriers along the length of an elongate fold in order to provide uniform depth of the fold in the sheet metal along the entire length of the fold and compensate for differences in extension of bending tool carrier actuators.

8. The method of operating a bending machine according to claim 7, wherein the elongate fold is along an edge of the sheet metal, the method further comprising the steps of:

actuating said bending tools extending from said bending tool carriers to fold the sheet metal against the clamping beams to form the elongate fold at an acute angle along the entire length of the sheet metal, the fold having a radius;

extending the elongate fold away from said clamp elements attached to the clamping beams;

clamping the sheet metal between said clamping elements so that the acute angle fold is spaced from said clamping elements;

extending said lower bending tools beneath the elongate fold so that the sheet metal bears against said lower bending tools;

extending said upper bending tools to bear against the edge of the sheet metal along the entire length of the acute angle fold; and using said upper bending tool to fold the edge of the sheet metal along the length of the acute angle fold towards said lower bending tools without shifting the point of contact between said upper bending tools and the sheet metal until a portion of the sheet metal adjacent the edge is parallel to the sheet metal held between the clamping elements, thereby defining a hem without slippage of the sheet metal along the hem.

9. The method of operating a bending machine according to claim 8, further comprising the step of pressing said upper bending tools against said lower bending tools along the edge of the sheet metal to form a crease in said hem.

* * * * *